US005139651A

United States Patent [19]

Forte

[11] Patent Number: 5,139,651

[45] Date of Patent: * Aug. 18, 1992

[54] AROMATIC EXTRACTION PROCESS USING MIXED POLYALKYLENE GLYCOL/GLYCOL ETHER SOLVENTS

[75] Inventor: Paulino Forte, Yonkers, N.Y.

[73] Assignee: UOP, Des Plaines, Ill.

[ * ] Notice: The portion of the term of this patent subsequent to Jun. 11, 2008 has been disclaimed.

[21] Appl. No.: 712,856

[22] Filed: Jun. 10, 1991

Related U.S. Application Data

[63] Continuation-in-part of Ser. No. 408,827, Sep. 18, 1989, Pat. No. 5,022,981.

[51] Int. Cl.[5] ..... C10G 21/16; C10G 21/28

[52] U.S. Cl. ..... 208/334; 208/321; 208/323; 208/332; 208/350; 208/353; 208/355; 208/358

[58] Field of Search ..... 208/323, 333, 321, 332, 208/339, 334, 347, 350, 353, 355, 358

[56] References Cited

U.S. PATENT DOCUMENTS

| | | | |
|---|---|---|---|
| 3,714,033 | 1/1973 | Somekh et al. | 208/321 |
| 3,788,980 | 1/1974 | Kubek et al. | 208/333 |
| 3,981,798 | 9/1976 | Ries et al. | 208/323 |
| 4,058,454 | 11/1977 | Asselin | 208/321 |
| 4,273,645 | 6/1981 | Audeh et al. | 585/864 |
| 4,379,047 | 4/1983 | Fenton | 208/323 |
| 4,493,765 | 1/1985 | Long et al. | 208/309 |
| 4,498,980 | 2/1985 | Forte | 208/321 |
| 4,571,295 | 2/1986 | Forte | 208/334 |
| 4,781,820 | 11/1988 | Forte | 208/333 |
| 5,022,981 | 6/1991 | Forte | 208/358 |

*Primary Examiner*—Anthony McFarlane

*Attorney, Agent, or Firm*—Thomas K. McBride; John G. Tolomei

[57] ABSTRACT

Processes are provided for the recovery of aromatic hydrocarbons from feeds comprising mixtures of aromatic and non-aromatic hydrocarbons using a mixed aromatic extraction solvent at extraction temperature of less than 250° F. The mixed extraction solvent is comprised of a solvent component containing low molecular weight polyalkylene glycols and a cosolvent component containing glycol ethers. Extractive distillation and steam distillation operations are employed to separate the hydrocarbon components from the rich solvent extract. Low temperature extraction followed by subsequent heating of the rich solvent stream results in improved solvent selectivity, reduced solvent to feed ratios, improved thermal stability and energy savings.

20 Claims, 2 Drawing Sheets

Feed
Raffinate
Extract

AROMATIC EXTRACTION PROCESS USING MIXED POLYALKYLENE GLYCOL/GLYCOL ETHER SOLVENTS

CROSS-REFERENCE TO RELATED APPLICATIONS

This application is a continuation-in-part of U.S. Ser. No. 408,827 filed on Sep. 18, 1989, now U.S. Pat. No. 5,022,981.

FIELD OF THE INVENTION

The present invention relates to processes for the recovery of aromatic hydrocarbon from feeds comprising mixtures of aromatic and non-aromatic hydrocarbons. In particular, the present invention provides low temperature aromatics extraction processes using mixed aromatic extraction solvents wherein improved selectivity and capacity can be achieved.

BACKGROUND OF THE INVENTION

Conventional processes for the recovery of high purity aromatic hydrocarbons such as benzene, toluene and xylenes (BTX) from various hydrocarbon feeds including catalytic reformate, hydrogenated pyrolysis gasoline, etc., utilize an aromatic selective solvent. Typically, in the practice of such processes, a hydrocarbon feed mixture is contacted in an extraction zone with an aqueous solvent composition which selectively dissolves the aromatic components from the hydrocarbon feed, thereby forming a raffinate phase comprising one or more non-aromatic hydrocarbons, and an extract phase comprising solvent having aromatic components dissolved therein.

It is generally desirable in aromatics extraction processes to use solvents that have high selectivity for the solute components as well as good solvency, or capacity. Generally, the higher the selectivity of a solvent, the higher the aromatic purity of the product produced. Often, however, it is found that solvents with high selectivity tend to have low solvency and solvents with high solvency tend to have poor selectivity. Accordingly, the choice of a particular solvent usually involves a compromise insofar as the above-identified properties are concerned.

There are a variety of solvents that have been proposed for aromatics extraction. These aromatic selective solvents generally contain one or more organic compounds containing in their molecule at least one polar group, such as a hydroxyl, amino, cyano, carboxyl or nitro radical. In order to be effective, the organic compounds of the solvent composition having the polar radical should have a boiling point substantially greater than the boiling point of the aromatic hydrocarbons to be extracted. In general, the solvent should also have a boiling point greater than the end boiling point of the aromatic component to be extracted from the hydrocarbon feed mixture. Typical solvents often comprise organic-containing compounds selected from aliphatic and cyclic alcohols, cyclic monomeric sulfones, the glycols and glycol ethers, as well as glycol amines, glycol esters and glycol ether esters. Some specific examples of aromatic extraction solvents commonly employed include; ethylene glycol, diethylene glycol, triethylene glycol, diglycolamine, tetraethylene glycol, dimethyl sulfoxide, sulfolane, acetonitrile, furfural, n-formyl morpholine, 3-methyl sulfolane, dimethyl formamide, phenol, methylethylketone, nitrobenzene and n-methyl pyrrolidone.

One type of aromatics extraction solvent of particular interest is the mixed extraction solvent described in U.S. Pat. Nos. 4,498,980 and 4,781,820. This mixed extraction solvent is comprised of a solvent component and a cosolvent component. The solvent component comprises the low molecular weight polyalkylene glycols of the formula:

$$HO—[CHR_1—(CR_2R_3)_n—O]_m—H$$

wherein n is an integer from 1 to 5 and is preferably the integer 1 or 2; m is an integer having a value of 1 or greater, preferably between about 2 to about 20 and most preferably between about 3 and about 8; and wherein $R_1$, $R_2$ and $R_3$ may be hydrogen, alkyl, aryl, aralkyl or alkylaryl and are preferably hydrogen and alkyl having between 1 and about 10 carbon atoms and most preferably are hydrogen.

The "cosolvent" component is a glycol ether of the formula:

$$R_4O—[CHR_5—(CHR_6—)—_xO]_y—R_7$$

wherein $R_4$, $R_5$, $R_6$ and $R_7$ may be hydrogen alkyl, aryl, aralkyl, alkylaryl and mixtures thereof with the proviso that $R_4$ or $R_7$ are not both hydrogen.

The above-identified patents disclose that the mixed extraction solvent is used in an extraction zone wherein the temperature is generally at least about 150° C. (302° F.) and is generally in the range of from about 150° C. (302° F.) to about 275° C. (527° F.). The patents further disclose that the mixed extraction solvent provides a certain unique balance of desirable characteristics including: (a) high selectivity for the aromatic feed components at the extraction temperatures; (b) high solvent capacity for the aromatic feed components at the extraction temperatures; (c) low capacity for the aromatic feed components at temperatures below the extraction temperatures; (d) chemical and thermal stability under the process conditions; (e) adaptability to a wider range of feeds; and (f) the solvent and cosolvent are sufficiently miscible to permit their recycle as a single recycled component.

The processes to which the use of the mixed extraction solvent has been directed are typically those wherein a bulk separation is desired, such as in the dearomatization of lube oil fractions. U.S. Pat. No. 4,781,820 specifically discloses a process for the dearomatization of a mixed hydrocarbon feed with low energy consumption in a continuous solvent extraction-solvent separation process that does not require the use of energy intensive downstream separation equipment, i.e., distillation, to recover the solvent from the aromatic product.

However, in some instances when high purity aromatics are desired, e.g., nitration grade aromatics, the energy intensive downstream separation equipment may be required in order to provide the desired product purity. Processes that utilize distillation operations for downstream separation typically employ an extractive distillation step to remove non-aromatic hydrocarbons from the rich solvent from the extractor followed by a steam distillation step to remove the aromatic hydrocarbons from the solvent.

One such process for producing hihg purity aromatics is described in U.S. Pat. No. 3,714,033 and provides for the use of a single distillation column wherein both extractive distillation and a steam stripping occur. The patent discloses the preferred use of a polyalkylene glycol solvent in a temperature range of from about 100° C. (212° F.) to about 200° C. (392° F.) to provide a high purity aromatics product.

Another process for producing high purity aromatics is described in U.S. Pat. No. 4,058,454 and provides for the use of extractive and steam distillation in separate columns. A particularly suitable class of solvents for use in the above-identified patent are those commonly referred to as the sulfolane type. The process utilizes an extraction temperature, with a sulfolane solvent, in the range of from about 80° to about 400° F. and can provide a high purity aromatic product.

In a number of instances where the production of high purity aromatics is desired, extraction operations are run at higher temperatures than the subsequent separation to remove the extract from the solvent. Three such references are U.S. Pat. No. 3,714,033 to Somekh, wherein the extract is cooled as it leaves the extractor to a temperature in the range of about 100°-125° C. before it enters a distillation zone. In a second reference, U.S. Pat. No. 3,431,199 to Reni, operates a multi-stage extractor high temperature with a high boiling organic selective solvent. After cooling the extract from the extraction column, the extract is conveyed to a decanter wherein two liquid phases are separated. The third reference, U.S. Pat. No. 4,498,980 to Forte employs a liquid/liquid extraction system based on a mixed extraction solvent wherein the aromatic rich solvent phase is cooled to promote the formation of two phases before it is brought to a distillation zone. Thus, each of the above references mandate that a rich solvent from the extraction zone must be cooled in order to separate the solvent from the aromatic and non-aromatic hydrocarbons. This is in complete contrast to the current invention where it was found to be desirable to heat the rich solvent stream before subsequent distillation and separation steps.

Not infrequently it is desired by refiners and other users of the above-described types of high purity aromatics extraction processes to increase the capacity or throughput of the units. Moreover, it is also desired to at least maintain or preferably improve the aromatics product purity. Hence, there is a need for aromatics extraction processes that utilize solvents having high selectivity and capacity which can provide a high purity aromatics product at high throughputs.

SUMMARY OF THE INVENTION

The present invention provides processes for the recovery of aromatic hydrocarbons which can produce high product purities at high throughputs using a mixed extraction solvent that has high selectivity and capacity, i.e., solvency. High product purities are achieved because the extraction step is performed at a temperature of less than 250° F. where the solvent selectivity is high. High throughputs are achieved because the mixed extraction solvent has high solvency even at temperatures of less than 250° F. and the rich solvent is heated before it is passed to a distillation zone. Accordingly, the solvent to feed ratio can be reduced as compared to some of the previously disclosed solvents.

The mixed extraction solvent of the present invention is a polyalkylene glycol of the formula:

$$HO—[CHR_1—(CR_2R_3)_n—O—]_mH$$

wherein n is an integer from 1 to 5, m is an integer from 1 to 10, and $R_1$, $R_2$ and $R_3$ may each be hydrogen, alkyl, aryl, aralkyl and mixtures thereof; and between about 0.5 and 99% by weight based on the total weight of the mixed extraction solvent of a polyalkylene glycol ether of the formula:

$$R_4O—[CHR_5—(CHR_6)_xO]_y—R_7$$

wherein x is an integer from 1 to 5 and y is an integer from 2 to 10 and wherein $R_4$, $R_5$, $R_6$ and $R_7$ may each be alkyl, aryl, aralkyl, alkylaryl and mixtures thereof with the proviso that $R_4$ or $R_7$ are not both hydrogen.

The process of the present invention includes the steps of; (a) contacting the feed in an extraction zone at a temperature of less than about 250° F. with the mixed aromatic extraction solvent to provide a rich solvent phase containing aromatic hydrocarbons and a raffinate phase containing non-aromatic hydrocarbons; (b) heating the rich solvent phase to at least 10° hotter than the extraction zone temperature and passing the heated rich solvent phase to a first distillation zone to provide a first distillate containing a reflux hydrocarbon phase and a first aqueous phase, and a first bottoms containing said aromatic hydrocarbons and the mixed extraction solvent; (c) passing the first bottoms to a second distillation zone to provide a second distillate containing an aromatic hydrocarbon phase and a second aqueous phase, and a second bottoms containing a lean solvent phase; (d) recycling at least a portion of the lean solvent phase to the extraction zone; (e) recycling at least a portion of the reflux hydrocarbon phase to the extraction zone; and (f) recovering an aromatic hydrocarbon product from the aromatic hydrocarbon phase and a non-aromatic hydrocarbon product from the raffinate phase.

DETAILED DESCRIPTION OF THE INVENTION

Figure 1:
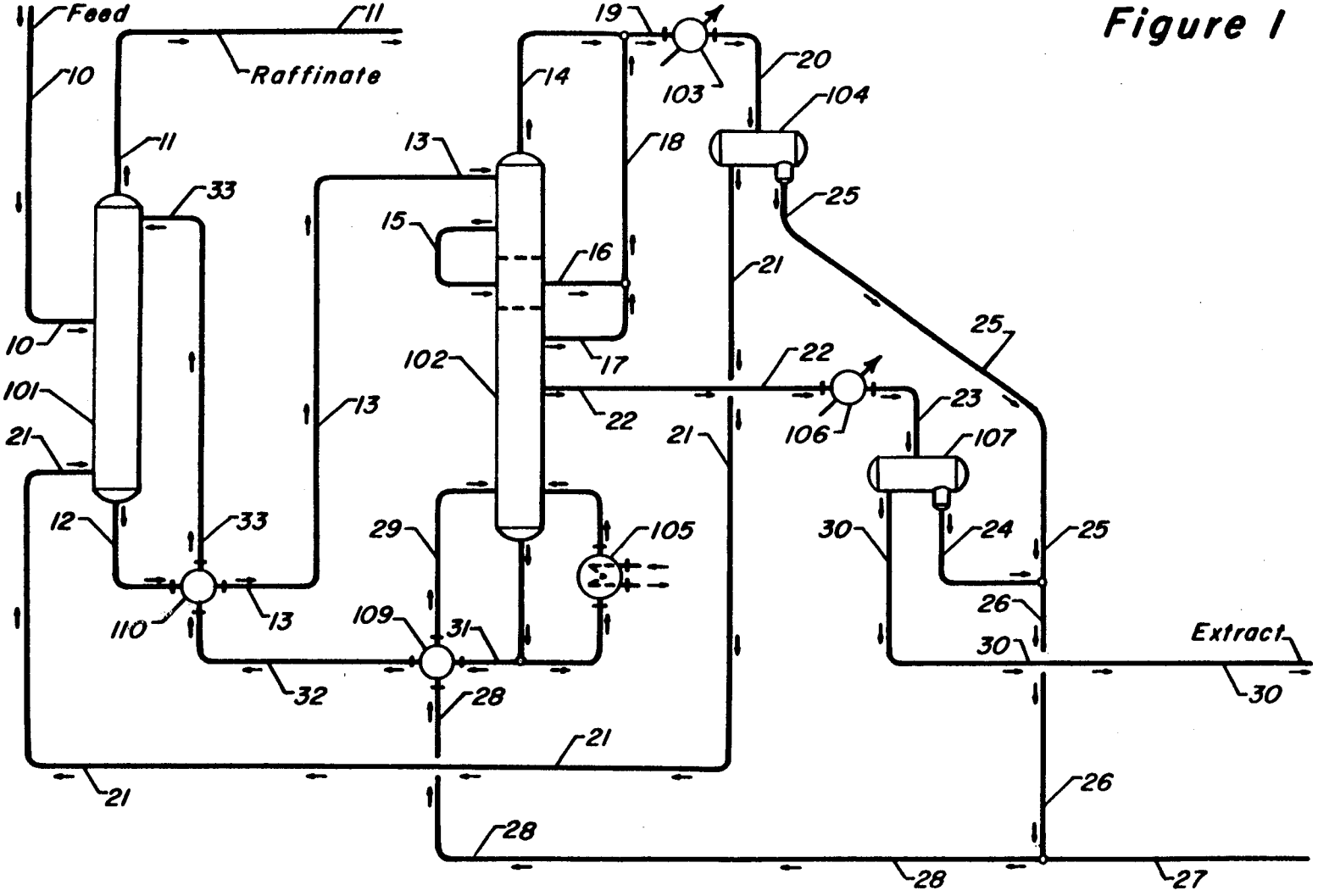
FIG. 1 is a schematic flow diagram of the process of the present invention wherein the rich solvent phase from the extraction zone is distilled in a single distillation column.

Hydrocarbon feedstocks suitable for utilization in the method of the present invention include many different aromatic-non-aromatic mixtures having a substantially high enough concentration of aromatic hydrocarbons to economically justify the recovery of the aromatic hydrocarbons as a separate product stream. The present invention is particularly applicable to hydrocarbon feed mixtures containing at least 10% by weight aromatic hydrocarbons. Typical aromatic feedstock charged to an extraction step will contain from about 25% to about 75% by weight aromatic hydrocarbons with aromatic hydrocarbon concentrations as high as 95% being suitable in some instances. A suitable carbon range for the hydrocarbon feedstock is from about 5 carbon atoms per molecule to about 20 carbon atoms per molecule, and preferably comprises aromatic hydrocarbons having from about 5 to about 12 carbon atoms per molecule and non-aromatic hydrocarbons having from about 5 to about 16 carbon atoms per molecule.

One suitable source of hydrocarbon feedstock is the liquid by-product from a pyrolysis gasoline unit which has been hydrotreated to saturate olefins and diolefins, thereby producing an aromatic hydrocarbon concentrate suitable for the solvent extraction technique described herein.

An especially preferred feedstock for use in the present invention is one recovered from a catalytic reforming unit, comprises single ring aromatic hydrocarbons of the $C_6$–$C_9$ range which are also mixed with corresponding boiling range paraffins and napthenes which are present in the product from a catalytic reforming unit.

The aromatic extraction solvent suitable for use in the present invention is a mixed aromatic extraction solvent. The term "mixed extraction solvent" as used herein shall mean a solvent mixture comprising a "solvent" component and a "cosolvent" component, as hereinafter defined.

The "solvents" component employed in the instant process are the low molecular weight polyalkylene glycols of the formula:

$$HO—[CHR_1—(CR_2R_3)_n—O]_m—H$$

wherein n is an integer from 1 to 5 and is preferably the integer of 1 or 2; m is an integer having a value of 1 or greater, preferably between about 2 to about 20 and most preferably between about 3 and about 8; and wherein $R_1$, $R_2$ and $R_3$ may be hydrogen, alkyl, aryl, aralkyl or alkylaryl and are preferably hydrogen and alkyl having between 1 and about 10 carbon atoms and most preferably are hydrogen. Examples of the polyalkylene glycol solvents employable herein are diethylene glycol, triethylene glycol, 1,3-butylene glycol, 1,2-butylene glycol, 1,5-pentaethylene glycol, and mixtures thereof and the like. Preferred solvents are diethylene glycol, triethylene glycol and tetraethylene glycol being most preferred.

The "cosolvent" component employed herein is a glycol ether of the formula:

$$R_4O—[CHR_5—(CHR_6—)_xO]_y—R_7$$

wherein $R_4$, $R_5$, $R_6$ and $R_7$ may be hydrogen, alkyl, aryl, aralkyl, alkylaryl and mixtures thereof with the proviso that $R_4$ or $R_7$ are not both hydrogen. The value of x is an integer from 1 to 5, preferably 1 or 2 and y may be an integer from 1 to 10 and is preferably from 2 to 7, and most preferably from 2 to 5. $R_4$, $R_5$, $R_6$ and $R_7$ are preferably selected from the group consisting of hydrogen and alkyl having 1 to about 10 carbons with the proviso that $R_4$ and $R_7$ may not both be hydrogen and most preferably $R_4$ is alkyl having from 1 to 5 carbons and $R_5$, $R_6$ and $R_7$ are hydrogen.

The mixture(s) of solvent and cosolvent is selected such that at least one solvent and one cosolvent are provided to form the mixed extraction solvent. The cosolvent generally comprises between about 0.5 and about 99% of the total weight of the mixed extraction solvent, preferably between about 5 and about 80% and most preferably between about 10 and about 50%.

Usually, the mixed extraction solvent utilized in the practice of this invention contain small quantities of water in order to balance the selectivity and capacity of the mixed extraction solvent for the aromatic hydrocarbons. The amount of water necessary to balance the selectivity and capacity as desired can be determined by one skilled in the art. Accordingly, the mixed extraction solvent composition of the present invention preferably contains from about 0.1 to about 20% by weight water and, preferably, about 0.5 to about 10% by weight depending upon the process conditions at which the extraction zone and the distillation zones are operated.

Aromatic hydrocarbons contained in the foregoing feedstocks are recovered by contacting the hydrocarbon feedstock in a solvent extraction zone maintained under solvent extraction conditions with the mixed extraction solvent of the type discussed. The solvent extraction zone provides a rich solvent, or extract phase, comprising mixed extraction solvent and aromatic hydrocarbons and a minor amount of non-aromatic hydrocarbons dissolved therein and a raffinate phase comprising non-aromatic hydrocarbons. The term "rich solvent phase" as used herein, denotes a mixture comprising the mixed extraction solvent of the present invention and aromatic hydrocarbons dissolved therein, wherein the concentration of said aromatic hydrocarbons is increased relative to a regenerated, or "lean solvent," phase. Typically, the raffinate phase is water washed to remove any mixed extraction solvent which may be in solution and entrained therein.

The extraction conditions utilized are correlated to maintain the mixed extraction solvent and hydrocarbons introduced into the extraction zone in the liquid phase so as to embody a liquid phase solvent extraction. In general, the conditions, apparatus, and mode of operation associated with the solvent extraction zone are well known to those trained in the art. For example, see U.S. Pat. Nos. 3,714,003, 4,419,226, and 4,781,820, hereby incorporated by reference. However, applicant has found that the use of the mixed extraction solvent hereinbefore described in combination with a particular extraction temperature range can provide enhanced extraction performance, i.e., enhanced capacity or selectivity or both. This enhancement is due to applicant's recognition that the mixed extraction solvent of the present invention has high solvency, i.e., capacity for aromatics, at low temperatures despite the general tendency of extraction solvents to have low solvency at low temperatures. Accordingly, it is now possible to perform the aromatics extraction at low temperatures wherein the selectivity for aromatic hydrocarbons is high, yet provide sufficient capacity to make such low temperature operation commercially possible.

Therefore, in accordance with the present invention, the extraction with the mixed extraction solvent is performed at a temperature of less than 250° F., preferably in the range of from about 100° to about 230° F., more preferably in the range of from about 120° to about 210° F., and most preferably in the range of from about 140° to about 190° F. As a result of performing the extraction using the mixed extraction solvent within the ranges of the present invention, several advantages can be realized. First, as noted above, the selectivity of the mixed extraction solvent for the aromatic hydrocarbons is enhanced at lower temperatures and hence, the purity of the aromatic product can be higher. Second, since the solvency, or capacity, of the mixed extraction solvent for aromatic hydrocarbons is maintained at the low temperatures of the present invention, the net effect of utilizing the mixed extraction solvent is that both high selectivity and high solvency can be achieved. Third, as a result of the higher solvency, reduced solvent to feed ratios can be employed thereby facilitating increased feed throughputs at existing solvent circulation rates or permitting reduced solvent circulation rates at existing feed throughputs. Fourth, the use of lower extraction temperatures can further improve the thermal stability of the mixed extraction solvent. Fifth, the process of the present invention can be operated to provide lower reflux to feed ratios and hence can provide energy savings.

The pressure in the extraction zone is selected to maintain all components in the liquid state and is typically in the range of about 75 psig to about 120 psig. As is well known in the art, however, one selected pressure is not maintained throughout the extraction zone as a result of the hydrostatic pressure of the liquid, but, rather, a high pressure within the stated range is present at the bottom of the zone and a low pressure again within the stated range is present at the top of the zone with an intermediate pressure in the middle of the zone.

Generally, to accomplish the extraction, the ratio of the mixed extraction solvent to hydrocarbon feed in the extractor zone is in the range from about 2 to about 20 parts by volume of mixed extraction solvent to one part by volume of feed, the ratio from about 2:1 to about 6:1 being preferred and the ratio from about 2:1 to about 4:1 being the most preferred. The broad range for the ratio of the mixed extraction solvent to hydrocarbon may be expanded upon depending on the particular solvent, cosolvent, relative amount of solvent to cosolvent, the amount of water in the mixed extraction solvent and the like. As used herein, the phrase "solvent to feed ratio" shall mean "mixed extraction solvent to feed ratio." The optimum solvent to feed ratio also depends upon whether high recovery (yield) or high purity (quality) is desired although the instant process will allow for both high recovery and high purity. As hereinbefore noted, the throughputs of existing aromatic extraction units can be increased with minor equipment modifications, e.g., as much as about 50%, by replacing an existing solvent such as tetraethylene glycol with the mixed extraction solvent of the present invention.

Also embodied within the solvent extraction process is the concept of displacing heavier-non-aromatic hydrocarbons from the extract phase at the lower end of the solvent extraction zone by utilizing the known technique of recycling the overhead from a stripping column, comprising a hydrocarbon containing reflux to that point. By displacing the heavy non-aromatics with light non-aromatics, the resulting non-aromatics are more readily separable from the aromatics in the subsequent distillation zones to be discussed later. It is preferred that this reflux stream comprise relatively light non-aromatic hydrocarbons but significant quantities of aromatic hydrocarbons, i.e., 30–60% by weight, may be present in the reflux stream. The exact amount of reflux introduced into the lower section of the solvent extraction zone varies depending on the degree of non-aromatic hydrocarbon rejection desired in the extraction zone. Preferably, the reflux is at least 5% volume of the extract phase, i.e., rich solvent phase, so as to insure effective displacement of the heavy non-aromatic hydrocarbons from the extract phase into the raffinate. According to the process of the present invention at least a portion, if not all, of the light non-aromatic reflux required is provided by a non-aromatic fraction removed as overhead from an upper section of a hereinafter described distillation zone. This fraction is withdrawn as a vapor and contains water (steam) which is preferably condensed and removed before the non-aromatics are passed as reflux to the solvent extraction zone. In accordance with the present invention, the preferred reflux to feed ratio is in the range of from about 0.2:1 to about 1:1 and the more preferred reflux to feed ratio is in the range of from about 0.2:1 to about 0.7:1.

The aromatics hydrocarbons extracted from the feed mixture in the extraction zone are removed in a rich solvent phase as hereinbefore described and heated by any available means to increase the temperature of the rich solvent phase by 10° to 150° F. hotter and preferably at least 30° F. hotter than the extraction zone before introducing it to a distillation section in order to recover the aromatic hydrocarbon product from the mixed extraction solvent. The heating of the rich solvent phase is preferably accomplished by direct or indirect heat exchange or combinations thereof.

In one arrangement of this invention, the lean solvent stream is exchanged against the rich solvent stream to provide the heating of the rich solvent stream. However, completely independent heating and cooling of the rich solvent stream and lean solvent stream can be accomplished with other streams having suitable temperatures. In accordance with the present invention, both extractive distillation and steam distillation operations are employed. These distillation operations are generally well known to those skilled in the art.

Typically, two types of column configurations are used in aromatics extraction processes, both of which are suitable for use with the present invention. In one type, a single column with a side-draw is employed to separate the rich solvent into an overhead stream rich in non-aromatic hydrocarbons, a side-draw stream rich in aromatic hydrocarbons, and a bottoms stream rich in mixed extraction solvent. In the other type, two columns are employed in such a manner that the first column is used to separate the rich solvent into an overhead stream rich in non-aromatic hydrocarbons, and a bottoms stream containing mixed extraction solvent and aromatic hydrocarbons. The second column is used to separate the bottoms stream from the first column into an overhead stream rich in aromatic hydrocarbons and a bottoms stream rich in mixed extraction solvent. For purposes of the present invention, both the upper section of the column in the single column configuration and the first column in the double column configuration can be considered as a first distillation zone. Similarly, the lower section of the column in the single column configuration and the second column in the double column configuration can be considered as a second distillation zone. Although the present invention is hereinafter described with reference to two distillation zones, the use of more than two zones is within the scope of the present invention.

The rich solvent phase is initially passed to the first distillation zone wherein the non-aromatic hydrocarbons contained therein are separated from the aromatic hydrocarbons and the mixed extraction solvent. Preferably, the rich solvent is flashed prior to its introduction into the first distillation zone in order to lower the pressure of the rich solvent to that of the first distillation zone which is typically lower than the extraction zone. The overhead distillate removed from the first distillation zone is condensed so as to comprise a reflux hydrocarbon phase and an aqueous phase. The aqueous phase often contains a small amount of mixed extraction solvent dissolved therein and accordingly is particularly suitable for use as stripping steam in the extractive stripping of the non-aromatic hydrocarbons from the aromatic hydrocarbons. The reflux hydrocarbon phase is then recycled to the extraction zone as hereinbefore described.

The bottoms from the first distillation zone comprising aromatic hydrocarbons and the mixed extraction solvent are then passed to the second distillation zone wherein the mixed extraction solvent is separated from the aromatic hydrocarbons. Preferably, steam stripping or a combination of steam stripping and reboiling are used in the second distillation zone. The aromatic hydrocarbons are removed as a distillate (or side-draw in the single column configuration) and are thereafter either recovered as product or more typically treated by water washing or distillation to remove any remaining mixed extraction solvent to low ppm levels.

When the single column configuration is utilized, it is preferred to treat the distillate, i.e., side draw, by rectification in a small column, e.g., about 10 or fewer trays. This rectification zone can be a separate column or an integral part of the main single column that contains the first and second distillation zones.

In the operation of the rectification zone, the side draw distillate is passed to a lower section of the rectification zone to separate therein the aromatic hydrocarbons from the mixed extraction solvent. This separation is accomplished by maintaining the rectification zone under conditions including a temperature of about 100° F. to about 400° F. and a pressure of about 50 mm. Hg to about 25 psig, preferably 1 psig to about 15 psig, and withdrawing from an upper section of the rectification zone a vapor fraction relatively free of mixed extraction solvent comprising aromatic hydrocarbons and water (steam). This vapor fraction is condensed and the aromatics recovered are relatively free of non-aromatics and mixed extraction solvent.

In one variation, the extract is removed as product and at least a portion of the aqueous phase of the condensate is returned to an upper section of the rectification zone as reflux. Any remaining portions of the aqueous phase which are essentially solvent free, are preferably used to wash the raffinate from the extractor. At least a portion, and preferably all, of the bottoms from the rectification zone which contain water and mixed extraction solvent are then passed to a lower section of the second distillation zone to provide stripping medium. It is to be noted that the rectifier bottoms can be heat-exchanged with other streams, e.g., the bottoms from the stripping zone, to vaporize the stripping medium prior to introducing it into the stripping zone.

In another variation, the aqueous phase of the condensate is not used to reflux the rectification zone. Instead, at least a portion of the extract phase is returned to an upper section of the rectification zone as reflux. Any remaining portions are preferably removed as product. The aqueous phase is, preferably, used to wash the raffinate. At least a portion, and preferably all, of the bottoms product of the rectification zone is returned to an upper section of the second distillation zone, preferably at about the same location, e.g., one tray below the location from which the side draw is withdrawn.

The rectification technique described above can provide an aqueous phase that is essentially solvent free, i.e., low ppm levels. This aqueous phase can conveniently be used to wash the raffinate from the extraction zone in order to recover the mixed extraction solvent dissolved therein. Preferably, the spent raffinate wash water is used to provide at least a portion of the stripping medium used in the second distillation zone. At least a portion of the bottoms from the second distillation zone which comprise a lean solvent, is passed to the extraction zone as hereinbefore described. The term "lean solvent" is used herein to denote a mixed extraction solvent having a reduced aromatic hydrocarbon content relative to the rich solvent.

DESCRIPTION OF THE DRAWINGS

Figure 2:
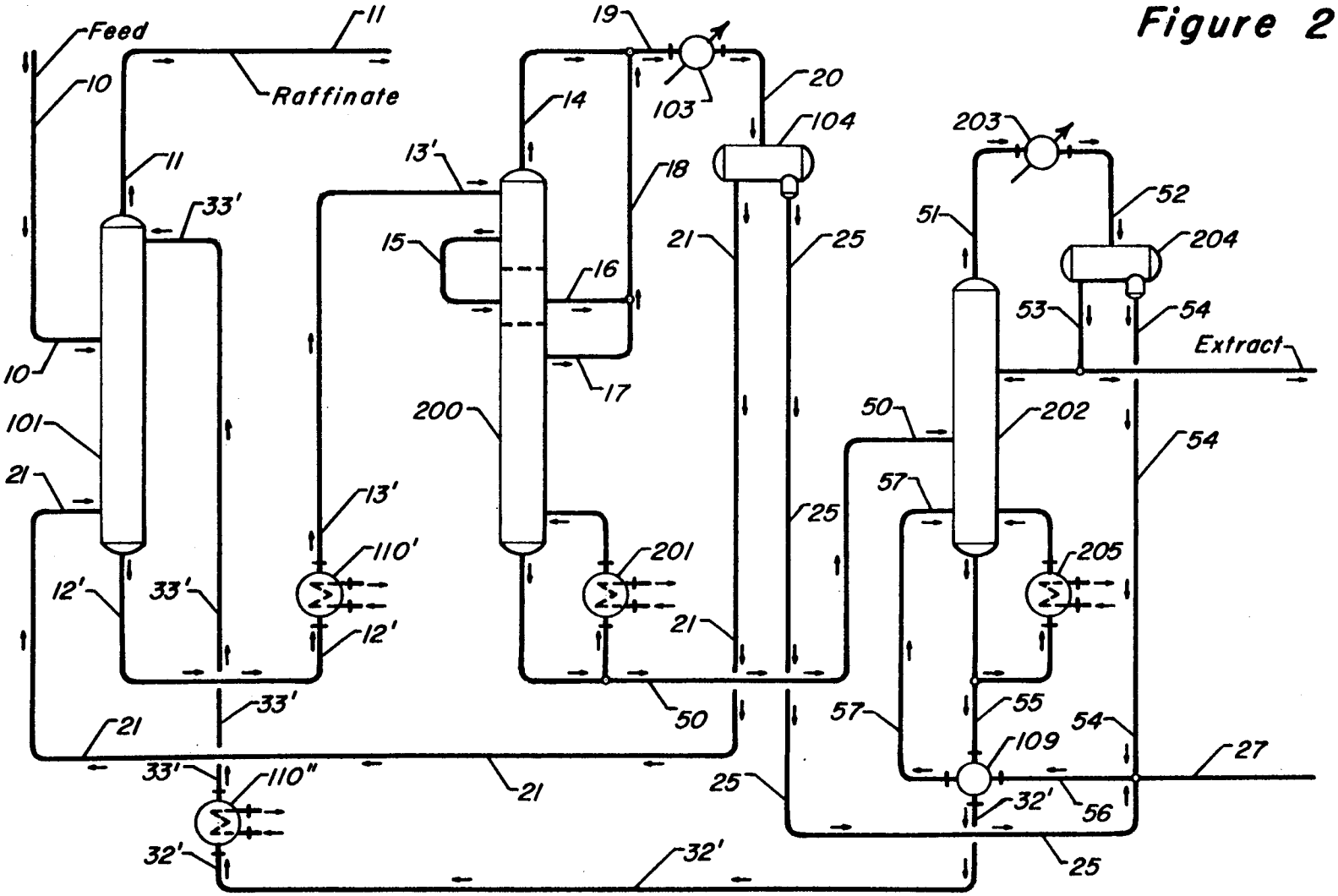
FIG. 2 is a schematic flow diagram of the process of the present invention wherein the rich solvent phase from the extraction zone is distilled initially in a first distillation column and subsequently in a second distillation column.

The further description of the method of this invention is presented with reference to the attached schematics, FIG. 1 and FIG. 2. The figures represent preferred aspects of the invention and are not intended to be a limitation on the generally broad scope of the invention as set forth in the claims. Of necessity, some miscellaneous appurtenances including valves, pumps, separators, heat exchangers, reboilers, etc., have been eliminated. Only those vessels and lines necessary for a complete and clear understanding of the process of the present invention are illustrated, with any obvious modifications made by those possessing expertise in the art of aromatic solvent extraction.

FIG. 1 is a schematic flow diagram of an aspect of the present invention wherein the first and second distillation zones are contained within a single distillation column.

A $C_6$–$C_9$ cut of depentanized reformate containing aromatic and non-aromatic hydrocarbons is passed via line 10 to extractor 101 which is maintained at extraction conditions including a temperature in the range of from about 140° to about 190° F. and a pressure in the range of from about 75 to about 120 psig along with lean solvent, via line 33, at a solvent to feed ratio of about 3 to 1 and reflux hydrocarbons, via line 21, at a reflux to feed ratio of about 0.5 to 1, the sources of which are hereinafter described. A raffinate phase containing non-aromatic hydrocarbons and mixed extraction solvent is removed from extractor 101 via line 11. The mixed extraction solvent is thereafter recovered from the raffinate phase by the following series of steps (not shown). First the raffinate phase is cooled to separate a portion of the dissolved mixed extraction solvent out of solution, the recovered solvent then optionally being recycled to extractor 101 and introduced at or near the feed point of line 10 or near the top of extractor 101, e.g., line 33. The non-aromatic raffinate phase is thereafter washed with water to further remove extraction solvent therefrom.

A rich solvent phase, i.e., extract, containing aromatic hydrocarbons, non-aromatic hydrocarbons, solvent and water, is removed from extractor 101 via line 12 and passed through heat exchanger 110 to an upper section of distillation column 102 via line 13 which contains at least one vaporizing section which functions to flash off and vaporize a portion of the non-aromatic hydrocarbons contained in the rich solvent phase line 13, a first distillation zone wherein extractive stripping occurs and a second distillation zone wherein primarily steam stripping and reboiling occur.

In the operation of distillation column 102, the rich solvent phase, as previously mentioned, is introduced into a flashing section in the upper section at superatmospheric pressure, e.g., 25 psig and a temperature of about 200 to about 250° F. Under these conditions, a portion of the non-aromatic hydrocarbons is flashed off and removed via line 14. The remainder of the extract phase is then passed via connecting line 15 into another flashing section at the same pressure as the distillation section of distillation column 102 where another portion of the non-aromatic hydrocarbons is vaporized and removed from the column as a vapor stream via line 16. The remainder of the non-aromatic hydrocarbons is removed via line 17 and combined with the non-aromatic hydrocarbons removed via line 16 and combined via line 18 with the flashed vapors from line 14 thereafter passed via line 19 to condensor 103 and then to tank 104 via line 20. The non-aromatic hydrocarbon condensate from tank 104 is then passed as reflux to extractor 101 via line 21 to a point near the bottom of the extractor. Finally, the residue of the extract phase, now comprising mixed extraction solvent having the desired aromatic hydrocarbons dissolved therein, is passed into the distillation section wherein extractive and steam stripping operations take place.

Column 102 is typically maintained at a pressure of from about 1 to 20 psig, more typically about 8 psig, and a temperature of from about 170°-250° F. at the overhead thereof, and typically at a pressure of from about 10 to 30 psig and a temperature of from about 260°-320° F. at the bottom of column 102, i.e., reboiler 105. A stripping medium, e.g., steam comprising mixed extraction solvent is introduced to the lower section of column 102 via line 29.

As aromatic hydrocarbons and mixed extraction solvent pass downward through column 102, extractive stripping of non-aromatic and aromatic hydrocarbons takes place above the side-cut, line 22, i.e., first distillation zone, and steam stripping of the aromatics from the mixed extraction solvent occurs below the side-cut, i.e., second distillation zone. Some steam stripping also occurs above the side-cut as the first and second distillation zones are in communication. The side-cut, i.e., line 22, is located at an intermediate section of column 102, i.e., the upper portion of the second distillation zone, and a side-cut distillate containing aromatic hydrocarbons is withdrawn via line 22 and passed through condensor 106 into tank 107 via line 23. The aqueous condensate from the side-cut distillate, line 24 is combined via line 26 with the overhead aqueous condensate from the first distillation zone, line 25, and further combined with the spent wash water from the raffinate water wash hereinbefore described, line 27, and passed to heat exchanger 109 via line 28 to the bottom of column 102 via line 29 for use as stripping steam as hereinbefore described. Typically, the aqueous phases from lines 24 or 25 are treated to remove solvent therefrom and thereafter used as clean wash water for the hereinbefore described raffinate washing. The aromatic containing hydrocarbon condensate from tank 107 is withdrawn via line 30 and further purified to remove solvent therefrom.

The bottoms stream from column 102 contains lean solvent which is passed via line 31 to exchanger 109 where it is cooled by indirect heat exchange with stream 28 to vaporize the stripping medium, stream 29. The partially cooled lean solvent stream, line 32, is thereafter further cooled to the extraction temperature by indirect heat exchange in heat exchanger 110 with the rich solvent stream 12 and passed to extraction zone 101 via line 33. As a result of heating the rich solvent stream in exchanger 110, the heat duty on reboiler 106 can be reduced as compared to processes that utilize higher extraction temperatures.

For example, the following Table 1 illustrates a comparison of performance between the mixed extraction solvent of the present invention and another single component solvent, tetraethylene glycol. The feedstock consists of 94,900 lb/hr of a $C_6$-$C_8$ cut having an aromatic content of 64.1 wt. %. The flow schemes used for the two cases were previously described with reference to FIG. 1 with the exception that exchanger 110 was omitted for the single solvent case and the stripping medium, line 28, was vaporized by indirect heat exchange with the rich solvent, line 12, in heat exchanger 109. As a result, a higher extraction temperature was utilized.

TABLE 1

| | SINGLE EXTRACTION SOLVENT (TETRA-ETHYLENE GLYCOL) | MIXED EXTRACTION SOLVENT (73% TETRA-ETHYLENE GLYCOL AND 27% METHOXYTRIGLYCOL) |
|---|---|---|
| | PROCESS VARIABLES | |
| Feed Rate (lb/hr) | 94,900 | 94,900 |
| Benzene Content (wt %) | 14.64 | 14.64 |
| Toluene Content (wt %) | 49.09 | 49.09 |
| $C_8$ Arom. Content (wt %) | .38 | .38 |
| Total Aromatics (wt %) | 64.11 | 64.11 |
| Extract Rate (lb/hr) | 60,709 | 60,763 |
| | EXTRACTOR COLUMN 101 | |
| Solv./Feed Ratio (wt) | 4.85 | 2.84 |
| Reflux/Feed Ratio (wt) | 0.70 | 0.55 |
| Lean Solvent Temp. (F.) | 308 | 176 |
| Water in Lean Solvent (wt %) | 5.7 | 5.3 |
| | STRIPPER COLUMN 102 | |
| Bottom Temperature (F.) | 308 | 310 |
| Top/bottom Press. (psig) | 5/10 | 5/10 |
| SW/Aromatics Ratio (wt) | 0.21 | 0.18 |
| Reboiler 106 Duty (MM Btu/hr) | 41.36 | 36.00 |
| | AROMATIC RECOVERIES | |
| Benzene (wt %) | 99.98 | 99.93 |
| Toluene (wt %) | 99.78 | 99.88 |
| $C_8$ Aromatics (wt %) | 93.10 | 96.87 |
| | PURITIES | |
| Benzene (wt %) | 99.95 | 99.96 |
| Non-Aromatics in Benzene (ppm) | 528 | 389 |
| | PROCESS HEAT DUTY | |
| Total in MM Btu/hr | 41.36 | 36.00 |

TABLE 1-continued

| | SINGLE EXTRACTION SOLVENT (TETRA-ETHYLENE GLYCOL) | MIXED EXTRACTION SOLVENT (73% TETRA-ETHYLENE GLYCOL AND 27% METHOXYTRIGLYCOL) |
|---|---|---|
| Total in Btu/lb Aromatic | 681.0 | 592.0 |

It can be seen from the above table that the total process heat duty was 681.0 BTU/lb aromatics recovered for the single extraction solvent case and 592.0 BTU/lb for the mixed extraction solvent case, i.e., a reduction of about 15%. Alternately, an existing unit operating under the conditions described for the single extraction solvent case could be retrofitted by replacing the solvent with the mixed extraction solvent and adding heat exchanger 110 to provide a cooling means for the lean solvent. As a result of the above-described changes, the throughput of the unit could be increased by about 50%.

It is to be understood that in the single column aspect of the present invention described above the first bottoms product need not be physically removed from the first distillation zone and passed to the second distillation zone. Further, the terms first and second distillation zones denote the concept that two separations are occurring, i.e., separation of the non-aromatic hydrocarbons from aromatics and solvent in the first zone and separation of the aromatics from the solvent in the second zone. The two zones exist in one continuous distillation column with the apparent boundary between the zones established by the side-cut draw point.

FIG. 2 is a schematic flow diagram of an aspect of the present invention wherein the first and second distillation zones are contained within separate distillation columns.

The description of extractor 101 and distillation column 200, i.e., column 102 hereinbefore presented with reference to FIG. 1, is applicable here unless otherwise indicated.

In the case of FIG. 2, heating of the lean solvent and rich solvent streams takes place independently across separate exchangers. After cooling in exchanger 109, line 32' carries the lean solvent to an exchanger 110'' that further cools the lean solvent that is transferred to extraction zone 101 by a line 12'. The rich solvent phase, removed from extractor 101 by line 12', is heated in an exchanger 110' and passed by line 13' to the distillation column 200.

The operating conditions in column 200 are typically in the same range as the operating conditions in previously described column 102, with the exception that column 200 does not employ steam stripping. Additionally, column 200 is occassionally arranged with only one flashing section rather than two as described with reference to column 102. Distillation column 200, i.e., first distillation zone, does not provide for the removal of a side-cut distillate, but rather is operated such that the bottoms obtained therefrom, which contains mixed extraction solvent and aromatic hydrocarbons, are passed via line 50 to distillation column 20 for separation of the aromatic hydrocarbons from the mixed extraction solvent.

Distillation column 202 is typically operated under vacuum at conditions of temperature and pressure sufficient to provide a substantially solvent-free aromatic overhead product in line 51, such as a top temperature of about 120°-200° F. and a top pressure of about 200-500 mmHg and a bottom temperature of about 250°-350° F., i.e., at reboiler 205, and a bottom pressure of about 400-700 mmHg. The overhead aromatic product is passed via line 51 through condensor 203 into tank 204 via line 52 to form an aromatic extract product phase and an aqueous phase. The aqueous phase withdrawn from tank 204 via line 54 is substantially free of mixed extraction solvent and can optionally be used as raffinate wash water (not shown) prior to being combined with spent raffinate wash water, line 27, and column 200 aqueous overhead distillate, line 25, and passed to the lower portion of column 202 via line 56, heat exchanger 109 and line 57 for use as stripping steam therein. The extract product containing aromatic hydrocarbons is withdrawn via line 53, a portion of which is used as reflux on column 202. The lean solvent is removed as bottoms and is passed via line 55 to exchanger 109 and to extractor 101 via line 32, heat exchanger 110 and line 33.

The following Table 2 illustrates the performance observed when the mixed extraction solvent of the present invention is used with a double distillation column configuration.

TABLE 2

| | MIXED EXTRACTION SOLVENT (77% TETRA-ETHYLENE GLYCOL AND 23% METHOXY-TRIGLYCOL) |
|---|---|
| PROCESS VARIABLES | |
| Feed Rate (lb/hr) | 94,900 |
| Benzene Content (wt %) | 14.64 |
| Toluene (wt %) | 49.09 |
| $C_8$ (wt %) | 0.38 |
| Total Aromatics (wt %) | 64.11 |
| Extract Rate (lb/hr) | 60,814 |
| EXTRACTOR COLUMN 101 | |
| Solvent/Feed Ratio (wt) | 2.83 |
| Reflux Feed Ratio (wt) | 0.53 |
| Lean Solvent Temperature (F.) | 176 |
| Water in Lean Solvent (wt %) | 3.3 |
| STRIPPER COLUMN 200 | |
| Bottom Temperature (F.) | 285 |
| Top/Bottom Pressure (psig) | 16/21 |
| Reboiler 201 Duty (MM Btu/hr) | 23.11 |
| RECOVERY COLUMN 202 | |
| Bottom Temperature (F.) | 300 |
| Reflux/Total HC Ratio (wt) | 0.14 |
| Top/Bottom Pressure (mm Hg) | 450/657 |
| Stripping Water/ Aromatic Ratio (wt) | 0.11 |
| Reboiler 205 Duty (MM Btu/hr) | 9.45 |
| AROMATIC RECOVERIES | |
| Benzene (wt %) | 99.94 |
| Toluene (wt %) | 99.89 |
| $C_8$ Aromatics (wt %) | 99.61 |
| PURITIES | |
| Benzene (wt %) | 99.96 |
| Non-Aromatics in Benzene (ppm) | 403 |
| PROCESS HEAT DUTY | |
| Total in MM Btu/lb | 32.56 |
| Total in Btu/lb Aromatic | 535.4 |

In addition to the aspects of the invention disclosed above, those skilled in the art will readily appreciate other variations within the scope of the claims set forth below. For example, the process can incorporate other miscellaneous steps such as washing, mixing, settling, decanting, as well as provide for various purge and make-up streams. Moreover, it shall be understood that the process of the present invention can include the use of alternate heat exchange schemes and exchangers and related equipment such as steam generators and the like.

I claim as my invention:

1. A process for the recovery of aromatic hydrocarbons from a feed comprising a mixture thereof with non-aromatic hydrocarbons, which comprises the steps of:

(a) contacting said feed in an extraction zone at a temperature of less than about 250° F. with a mixed extraction solvent and a reflux hydrocarbon phase to provide a rich solvent phase containing aromatic hydrocarbons and a raffinate phase containing non-aromatic hydrocarbons, wherein the mixed extraction solvent comprises a polyalkylene glycol of the formula $$HO—[CHR_1—(CR_2R_3)_n—O—]_mH$$

wherein n is an integer from 1 to 5, m is an integer having a value of 1 or greater and $R_1$, $R_2$ and $R_3$ are selected from hydrogen, alkyl, aryl, aralkyl, alkylaryl and mixtures thereof and a glycol ether of the formula $$R_4O—[CHR_5—(CHR_6)_xO]_y—R_7$$

wherein $R_4$, $R_5$, $R_6$ and $R_7$ are selected from hydrogen, alkyl, aryl, aralkyl, alkylaryl and mixtures thereof; $R_4$ and $R_7$ are not both hydrogen; x is an integer from 1 to 5; and y is an integer from 2 to 10, said glycol ether comprising from about 5 to 50 wt. % of the mixed extraction solvent;

(b) heating said rich solvent phase to a temperature 10° to 150° F. hotter than the extraction zone temperature to provide a heated rich solvent phase;

(c) passing said heated rich solvent phase to a first distillation zone to provide a first distillate comprising a reflux hydrocarbon phase and a first aqueous phase, and a first bottoms comprising said aromatic hydrocarbons and said aromatic extraction solvent;

(d) passing said first bottoms to a second distillation zone to provide a second distillate comprising an aromatic hydrocarbon phase and a second aqueous phase, and a second bottoms comprising said lean solvent phase; (e) cooling at least a portion of said lean solvent phase to the extraction zone temperature of step (a);

(f) recycling at least a portion of said cooled lean solvent phase to the extraction zone; and (g) recycling at least a portion of said reflux hydrocarbon phase to a point near the bottom of the extraction zone of step (a).

2. The process of claim 1 wherein the mixed extraction solvent consists essentially of a polyalkylene glycol selected from the class consisting of diethylene glycol, triethylene glycol, tetraethylene glycol and mixtures thereof and a glycol ether selected from the class consisting of methoxytriglycol, ethoxytriglycol, butoxytriglycol, methoxytetraglycol and ethoxytetraglycol and mixtures thereof.

3. The process of claim 2 wherein the polyalkylene glycol is tetraethylene glycol and the glycol ether is methoxytriglycol.

4. The process of claim 1 wherein the temperature in the extraction zone is from about 100° to about 230° F.

5. The process of claim 1 wherein said rich solvent phase is heated to a temperature at least 30° F. higher than the temperature of the extraction zone temperature.

6. The process of claim 5 wherein the temperature in the extraction zone is from about 140° to about 190° F.

7. The process of claim 1 wherein the pressure in the extraction zone is from about 75 to about 120 psig.

8. The process of claim 1 wherein the ratio of lean solvent to feed in the extraction zone is in the range of about 2 to about 6 parts by volume of lean solvent to one part by volume of feed.

9. The process of claim 1 wherein the ratio of reflux hydrocarbons to feed in the extraction zone is in the range of about 0.2 to about 1.0 parts by volume of reflux hydrocarbons to one part by volume of feed.

10. The process of claim 1 which further comprises passing at least a portion of one or both of said first and second aqueous phases to a lower section of the second distillation zone to provide a stripping medium therein.

11. The process of claim 1 wherein said feed comprises aromatic hydrocarbons having from about 5 to about 12 carbon atoms per molecule and non-aromatic hydrocarbons having from about 5 to about 16 carbon atoms per molecule.

12. The process of claim 1 comprising heating said rich solvent phase to a temperature higher than the extraction zone temperature and within the range of from about 170°-320° F. prior to passing said rich solvent to the first distillation zone.

13. A process for the recovery of aromatic hydrocarbons from a feed comprising a mixture thereof with non-aromatic hydrocarbons, which comprises the steps of:

(a) contacting said feed in an extraction zone at a temperature of less than about 250° F. with an aromatic extraction solvent and a reflux hydrocarbon phase to provide a rich solvent phase containing aromatic hydrocarbons and a raffinate phase containing non-aromatic hydrocarbons, wherein the aromatic extraction solvent comprises a polyalkylene glycol of the formula $$HO—[CHR_1—(CR_2R_3)_n—O—]_mH$$

where n is an integer from 1 to 5, m is an integer having a value of 1 or greater and $R_1$, $R_2$ and $R_3$ are selected from hydrogen, alkyl, aryl, aralkyl, alkylaryl and mixtures thereof and a glycol ether of the formula $$R_4O—[CHR_5—(CHR_6)_xO]_y—R_7$$

wherein $R_4$, $R_5$, $R_6$ and $R_7$ are selected from hydrogen, alkyl, aryl, aralkyl, alkylaryl and mixtures thereof; $R_4$ and $R_7$ are not both hydrogen; x is an integer from 1 to 5; and y is an integer from 2 to 10, said glycol ether comprising from about 5 to 50 wt. % of the mixed extraction solvent;

(b) heating said rich solvent phase by direct or indirect heat exchange to a temperature 10° to 150° F. hotter than the extraction zone temperature to provide a heated rich solvent phase;

(c) passing said heated rich solvent phase to a distillation column to provide a first distillate comprising a reflux hydrocarbon phase, a column bottoms comprising said lean solvent phase containing mixed extraction solvent, and a second distillate comprising aromatic hydrocarbons, water and mixed extraction solvent;

(d) passing the second distillate to a rectification zone maintained at effective conditions to separate the aromatic hydrocarbons from the mixed extraction solvent, withdrawing a rectification distillate comprising an extract phase containing aromatic hydrocarbons and a rectification aqueous phase, withdrawing a rectification bottoms comprising mixed extraction solvent, and passing a portion of the rectification aqueous phase or the extract phase to an upper portion of the rectification zone as reflux thereon;

(e) Cooling said lean solvent phase to provide a cooled lean solvent phase;

(f) recycling at least a portion of said cooled lean solvent phase to the extraction zone; and, (g) recycling at least a portion of said reflux hydrocarbon phase to a point near the bottom of the extraction zone.

14. The process of claim 13 comprising passing at least a portion of the rectification aqueous phase to an upper portion of the rectification zone and withdrawing a rectification zone bottoms comprising water and mixed extraction solvent.

15. The process of claim 13 comprising passing a portion of the extract phase to an upper portion of the rectification zone, withdrawing a rectification zone bottoms comprising aromatic hydrocarbons and mixed extraction solvent and passing at least a portion of the rectification zone bottoms to the distillation column.

16. The process of claim 15 comprising withdrawing the remaining portion of the extract phase as a purified aromatic product.

17. The process of claim 13 wherein the temperature in the extraction zone is from about 120° to about 210° F.

18. The process of claim 13 wherein the ratio of lean solvent to feed in the extraction zone is in the range of from about 2 to about 6 parts by volume of lean solvent to one part by volume of feed.

19. The process of claim 13 comprising heating said rich solvent phase to a temperature within the range of from 170°-320° F. prior to passing said rich solvent to the distillation column.

20. The process of claim 13 wherein said rich solvent phase is heated to a temperature at least 30° F. higher than the extraction zone temperature.

* * * * *